US009084923B2

(12) United States Patent
Jackson

(10) Patent No.: US 9,084,923 B2
(45) Date of Patent: Jul. 21, 2015

(54) MARTIAL ARTS TRAINING DEVICE

(71) Applicant: Daniel Terrance Jackson, Henderson, NV (US)

(72) Inventor: Daniel Terrance Jackson, Henderson, NV (US)

(73) Assignee: Daniel Terrance Jackson, Henderson, NV (US)

( * ) Notice: Subject to any disclaimer, the term of this patent is extended or adjusted under 35 U.S.C. 154(b) by 67 days.

(21) Appl. No.: 13/986,714

(22) Filed: May 28, 2013

(65) Prior Publication Data

US 2013/0324369 A1 Dec. 5, 2013

Related U.S. Application Data

(60) Provisional application No. 61/653,099, filed on May 30, 2012.

(51) Int. Cl.

| | |
|---|---|
| ***A63B 69/34*** | (2006.01) |
| ***A63B 69/00*** | (2006.01) |
| *A63B 69/20* | (2006.01) |
| *A63B 71/00* | (2006.01) |
| *A63B 71/06* | (2006.01) |

(52) U.S. Cl.

CPC ..... *A63B 69/004* (2013.01); *A63B 69/20* (2013.01); *A63B 2071/009* (2013.01); *A63B 2071/0063* (2013.01); *A63B 2071/0625* (2013.01); *A63B 2071/0694* (2013.01); *A63B 2210/50* (2013.01); *A63B 2220/801* (2013.01); *A63B 2220/833* (2013.01); *A63B 2225/09* (2013.01); *A63B 2225/093* (2013.01)

(58) Field of Classification Search

CPC ..... A63B 69/004; A63B 69/20; A63B 69/24; A63B 69/32; A63B 69/34; A63B 69/345; A63B 2071/0063; A63B 2071/0625; A63B 2220/801; A63B 2220/833

USPC ..... 482/77, 78, 83–90, 148, 26–29, 66–69; 446/71, 75, 76, 227, 236; 297/273–275; 473/438, 441–446; 472/14, 135; 248/95–97, 121, 143, 248/149, 172, 346.07, 523, 539, 910

See application file for complete search history.

(56) References Cited

U.S. PATENT DOCUMENTS

| | | | | | |
|---|---|---|---|---|---|
| 1,032,139 | A * | 7/1912 | Hart | 482/90 |
| 4,157,801 | A * | 6/1979 | Elmer | 248/97 |
| 4,773,639 | A * | 9/1988 | Graves | 482/66 |
| 4,836,533 | A * | 6/1989 | Dong | 482/83 |
| 5,449,335 | A * | 9/1995 | Steinfeld | 482/110 |
| 5,524,881 | A * | 6/1996 | Edward | 473/447 |
| 5,554,088 | A * | 9/1996 | Zlojutro | 482/83 |
| 5,697,872 | A * | 12/1997 | Stronsick et al. | 482/83 |
| 5,700,230 | A * | 12/1997 | Cardona | 482/83 |
| 5,728,031 | A * | 3/1998 | Honeycutt | 482/83 |
| 5,928,117 | A * | 7/1999 | Vittone et al. | 482/99 |
| 6,537,077 | B1 * | 3/2003 | Johnson | 434/258 |
| 6,827,673 | B2 * | 12/2004 | Chen et al. | 482/77 |
| 7,338,339 | B2 * | 3/2008 | Mendel | 446/85 |

(Continued)

*Primary Examiner* — Stephen Crow
*Assistant Examiner* — Gregory Winter

(57) ABSTRACT

A martial arts training device that includes an inner frame shaped to encircle an outer surface of a training bag, an outer frame shaped to encircle the inner frame, a plurality of support shafts, and a locking mechanism. Both the inner and outer frame have a plurality of corresponding tee fittings. The support shafts connect the corresponding tee fittings and a locking mechanism is configured to adjust the width of the inner frame to fit the outer surface of the punch bag.

13 Claims, 9 Drawing Sheets

(56) References Cited

U.S. PATENT DOCUMENTS 8,029,422 B2 * 10/2011 Strong et al. ..... 482/83
8,033,891 B2 * 10/2011 Mendel ..... 446/236
8,308,616 B1 * 11/2012 Flavell ..... 482/10
2003/0216228 A1 * 11/2003 Rast ..... 482/84
2004/0075037 A1 * 4/2004 Krier et al. ..... 248/523
2005/0187083 A1 * 8/2005 Krystoff ..... 482/140
2008/0012409 A1 * 1/2008 Chen et al. ..... 297/274

* cited by examiner

Fig. 2b
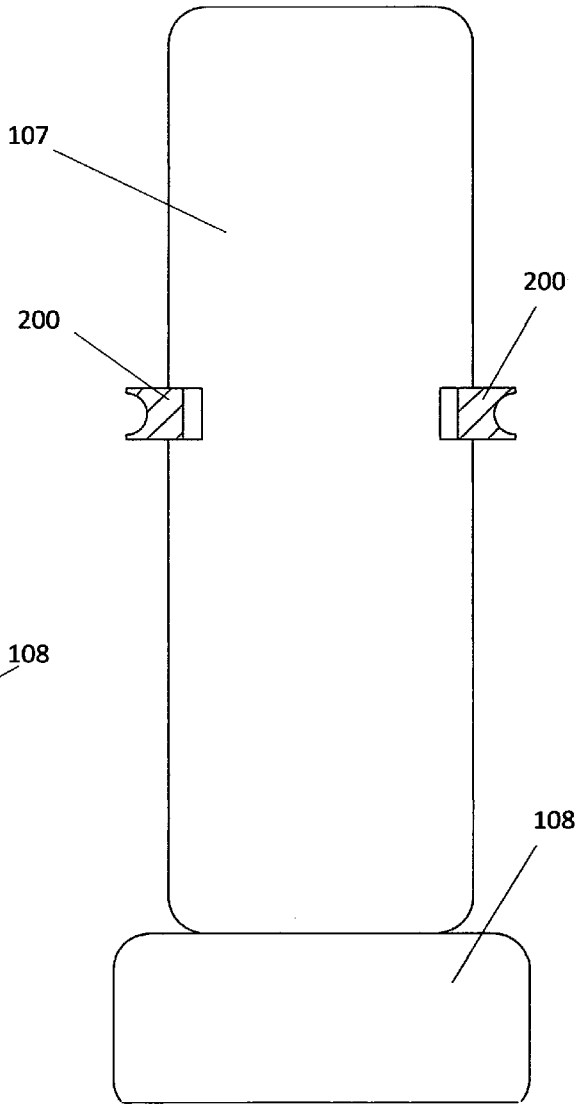
Fig. 2c
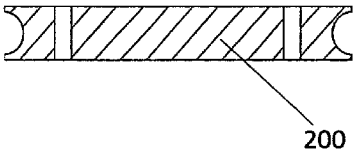
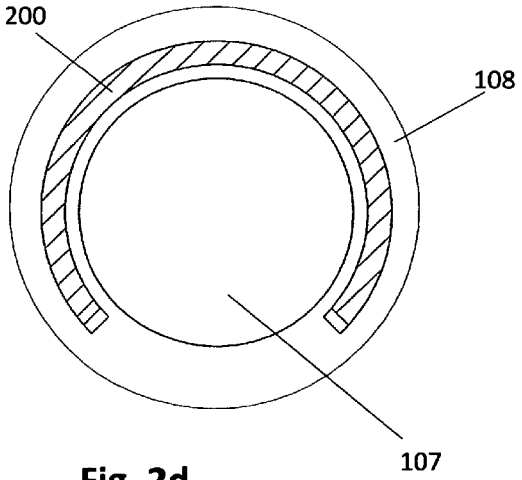
Fig. 2d

MARTIAL ARTS TRAINING DEVICE

CROSS-REFERENCE TO RELATED APPLICATIONS

This non-provisional application claims priority of U.S. Provisional Patent Application No. 61/653,099, filed on May 30, 2012, and entitled "a martial arts training device that improves ones kicks and punches" which is incorporated herein by reference in its entirety.

BACKGROUND OF THE INVENTION

The present application relates generally to devices usable with martial arts training activities, and more particularly to the area of the training practitioner's form, balance, and proper extension of techniques.

In the field of martial arts, sparring and form (kata) are the primary means or methods used to test or challenge the practitioner's physical and mental level of development. For the martial artist, form, balance, and proper extension of technique are crucial to have superior technique. At higher levels of martial arts competition, electronic protective equipment with imbedded sensors is used to register proper contact with your opponent. It is therefore essential that the competitor use accurate techniques and proper form, since solid sensor-to-sensor contact is needed, to score a valid point. Previously, a practitioner could only refine techniques and develop powerful strikes and kicks using a conventional training bag; however, the bag offers no immediate response or indicator to acknowledge the correct form of a strike or kick.

The martial arts training device solves these concerns by providing an actual obstruction on which the practitioner must focus his/her strikes and kicks, over or under, to produce the correct extension and proper form for fighting techniques. When used correctly, the martial arts training device compels the user to lift and extend a punch or kick properly for full power and efficient movement, along with proper recovery between techniques. The martial arts training device is universal: it can easily be mounted at any height on virtually all training bags, and can be pre-adjusted for quicker installation. Along with its adaptability in mounting, it can be disassembled and folded in minutes for storing or transporting.

BRIEF DESCRIPTION OF THE INVENTION

In one embodiment, a martial arts training device is provided that includes an inner frame shaped to encircle an outer surface of a training bag, and an outer frame shaped to encircle the inner frame, wherein the inner frame has a center that is located at a different position than the center of the outer frame.

BRIEF DESCRIPTION OF THE DRAWINGS

FIG. 2*b* is a back view of the reducer shown in FIG. 2*a* mounted on a standing bag without the martial arts training device shown in FIG. 1.

FIG. 2*c* is a back view of the reducer shown in FIG. 2*a*.

FIG. 2*d* is a top view of the reducer shown in FIG. 2*a* mounted on a standing bag without the martial arts training device shown in FIG. 1.

DETAILED DESCRIPTION OF THE INVENTION

Reference will now be made in detail to an embodiment of a martial arts training device, an example of which is shown in the accompanying drawings. This invention should not be construed as limited to the embodiments described and/or illustrated below; such embodiments are provided only as examples so this disclosure may satisfy all applicable legal requirements. Like numbers refer to like elements throughout.

Figure 1:
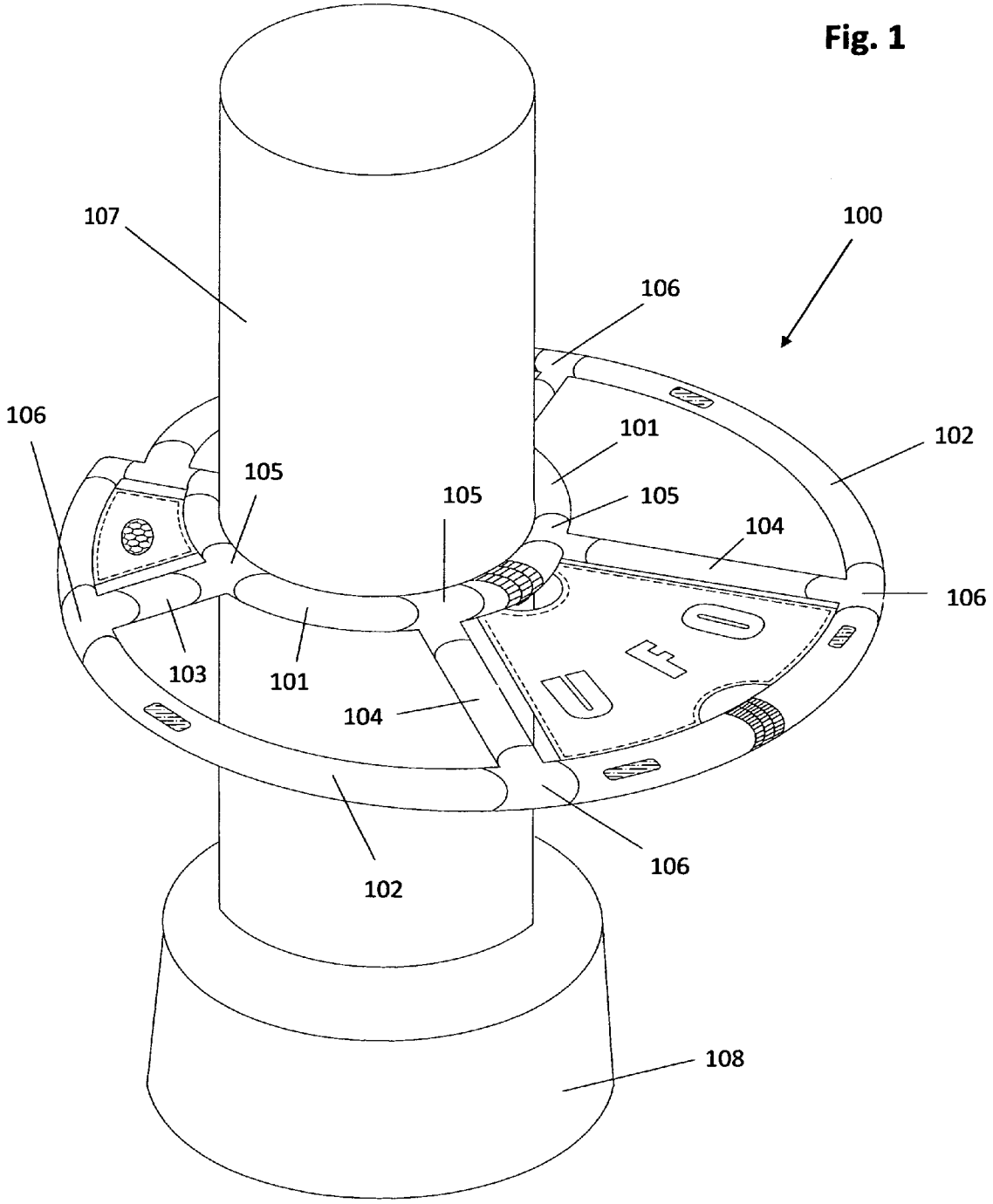
FIG. 1 is a perspective view of an exemplary martial arts training device attached to a standing bag.

FIG. 1 illustrates a martial arts training device 100 attached to a standing bag 107, along with a standing bag base 108 used to support the martial arts training device 100. The martial arts training device 100 can easily be moved up and down the standing bag 107 to achieve different heights, according to the various needs and sizes of the practitioner. The martial arts training device 100 includes an inner frame 101 that secures the martial arts training device 100 to the standing bag 107. A set of inner non-threaded tee fittings 105 connects the inner frame 101 to a set of rear support shafts 103 and a set of front support shafts 104. The support shafts 103 and 104 are then connected to the outer frame 102 by an outer non-threaded tee fitting 106. This configuration of two sets of support shafts (103 and 104), different in length, joined together by an inner frame 101 and outer frame 102, form a unique oblique shape that creates several different striking distances to the standing bag 107. The chief components of the martial arts training device 100, such as the inner frame 101, outer frame 102, inner non-threaded tee fittings 105, outer non-threaded tee fittings 106, and support shafts 103 and 104 typically include or are made of a plastic and/or a rubber type of tubing covered by foam or a foam-like padding. The padding absorbs the impact of an accidental strike to the martial arts training device 100.

Figure 2A:
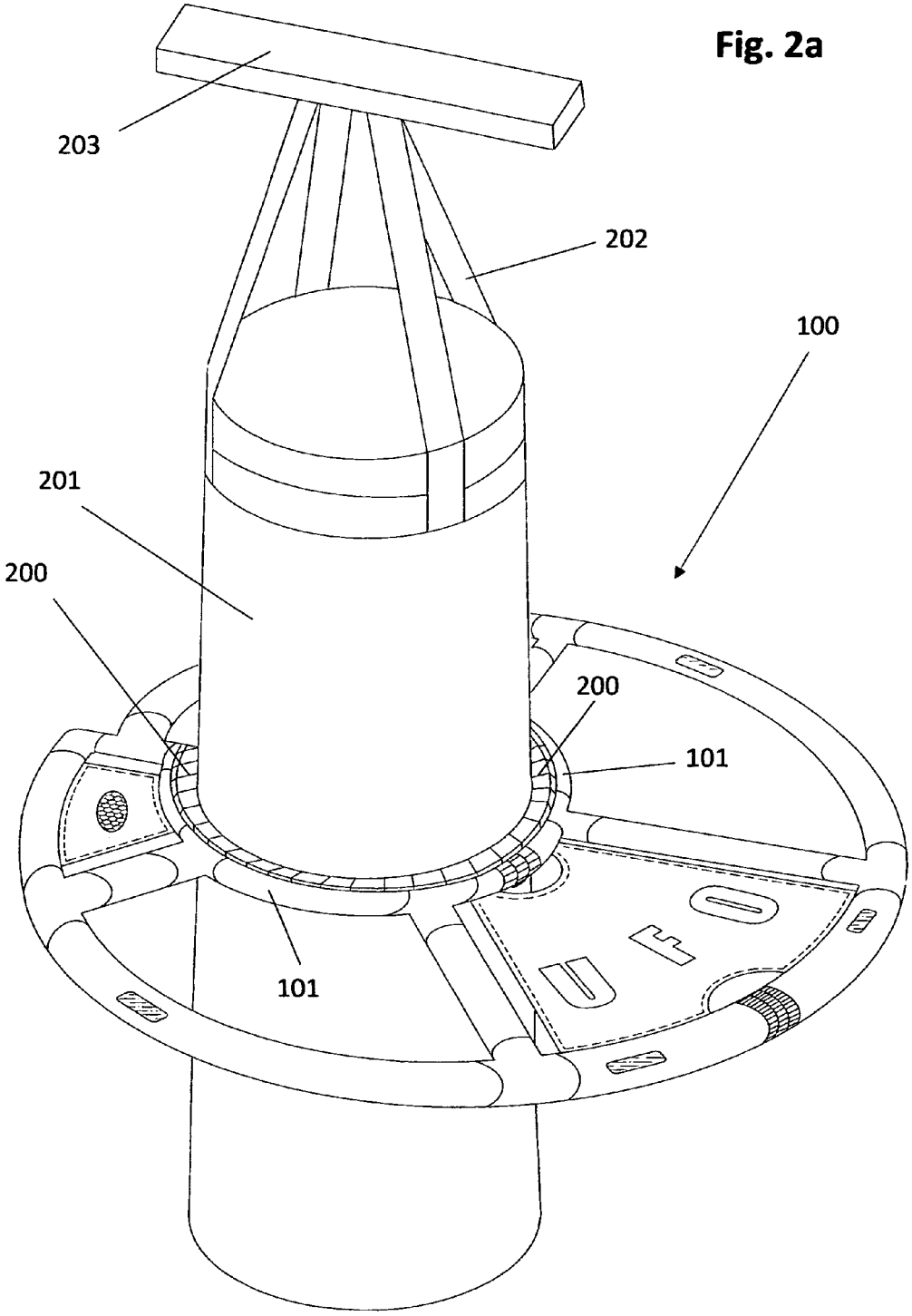
FIG. 2*a* is a perspective view of an exemplary reducer that may be used along with the martial arts training device, as shown in FIG. 1.

FIG. 2*a* shows a reducer 200 installed on the martial arts training device 100 while it is attached to a hanging bag 201. It also illustrates support straps 202 and a support structure 203, which suspends the hanging bag 201 from the floor. Once installed, the reducer 200 decreases the overall inner diameter of the inner frame 101, allowing the martial arts training device 100 to be mounted securely onto hanging bags 201 or standing bags 107 that have a smaller circumference. The reducer 200 may be made of a plastic- and/or rubber-type material.

FIG. 2*b* illustrates a back view of the reducer 200 as installed onto a standing bag 107. Once the reducer 200 is placed at the desired height, the martial arts training device 100 can easily be installed and secured to the standing bag 107 or the hanging bag 201. It should be recognized that the standing bag 107 and the hanging bag 201 may also be referred to as training bags.

FIG. 2*c* illustrates a back view of the reducer 200 detached from the martial arts training device 100.

FIG. 2*d* illustrates a top view of the reducer 200 mounted on the standing bag 107. The reducer 200 is designed to fit between the standing bag 107 and the inner frame 101 of the martial arts training device 100. When installed onto the martial arts training device 100, the overall circumference of the reducer 200 will decrease as it clamps firmly around the standing bag 107, reducing the diameter of the inner frame 101. When the reducer 200 is installed on the standing bag 107 with the martial arts training device 100, the inner surface of the reducer 200 will be flush against the outer surface of the standing bag 107, holding the reducer 200 and the martial arts training device 100 in position.

Figure 3:
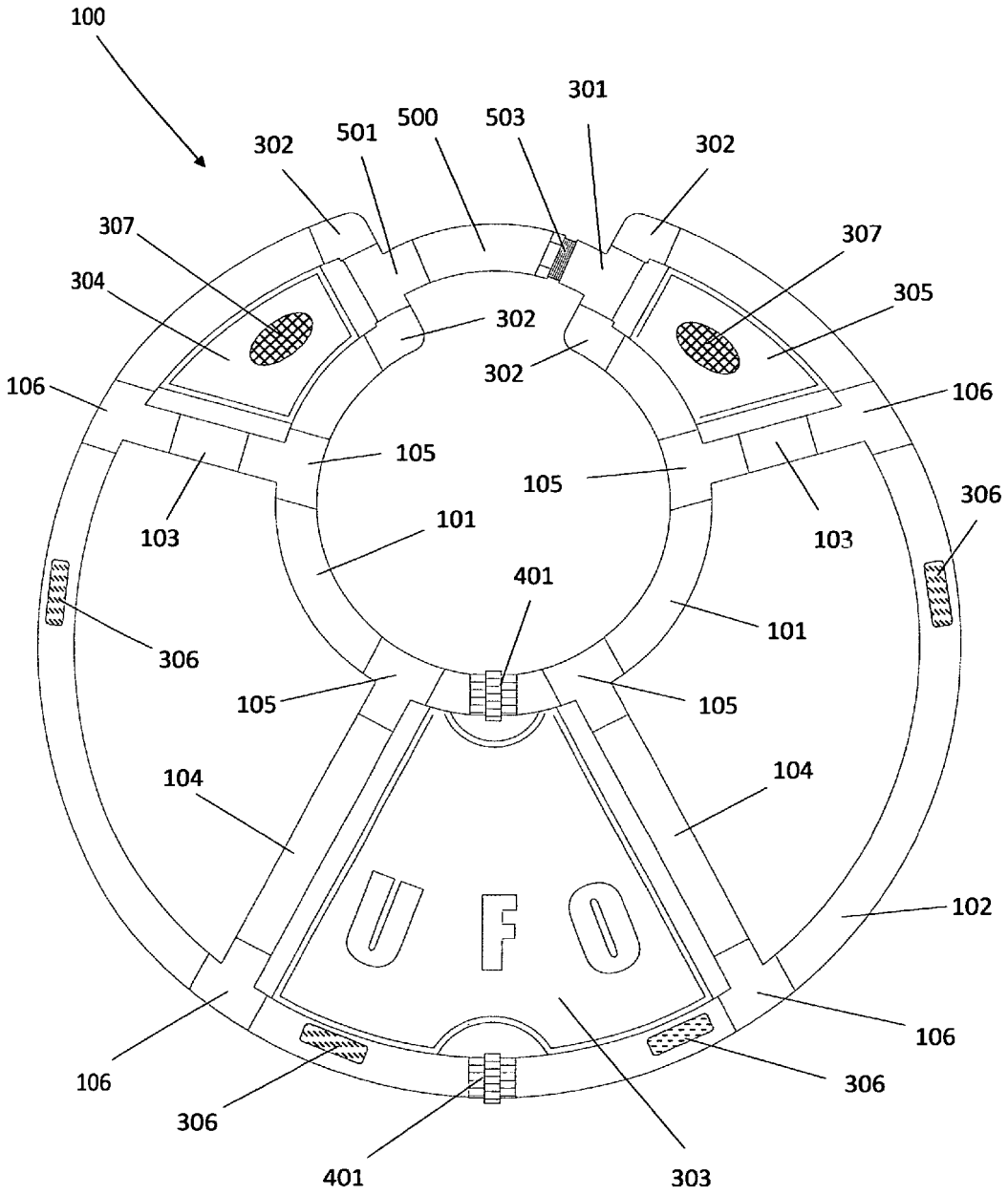
FIG. 3 is a perspective view of the martial arts training device shown in FIG. 1.

FIG. 3 illustrates a top view of the martial arts training device 100 with all its components. The martial arts training device 100 is positioned primarily by the main clamp 500 onto the standing bag 107 and the hanging bag 201, discussed under FIG. 5. A union fitting 401, discussed under FIG. 4, allows the martial arts training device 100 to be disassembled for transport and storage. A female inside threaded tee fitting 301 that works as a swivel connects the main clamp 500 to an elbow 302, which then connects the inner frame 101 and the outer frame 102 of the martial arts training device 100. The martial arts training device 100 has a main front visual skin 303, a left rear visual skin 304, and a right rear visual skin 305. These visual skins 303, 304, and 305 are designed to provide a visual guide for those practicing on the martial arts training device 100. The visual skins 303, 304, and 305 are made of a flexible, foldable material to enable the martial arts training device 100 to be folded for storage and/or transportation.

The martial arts training device 100 is designed to be used as an obstruction, forcing practitioners to strike the training bag over or under the martial arts training device 100 with their technique, rather than as a target to be hit, like most training devices. For this reason, the martial arts training device 100 is equipped with one or more touch sensors 306 and audible speakers 307. FIG. 3 shows the touch sensors 306 placed along the outer frame 102, although the touch sensors 306 or the audible speakers 307 may be placed anywhere on the martial arts training device 100. If the martial arts training device 100 is struck forcefully, the touch sensor 306 activates the audible speaker 307 to inform the user of the unwanted contact. The touch sensor 306 and the audible speaker 307 may be turned off and on by a power switch (not shown) supplied by one or more batteries located on the underside of the main clamp 500.

The martial arts training device 100 was created to provide an obstruction and focusing method for martial artists to develop their techniques. To make contact with the standing bag 107 and the hanging bag 201, practitioners must lift their knees and rotate their hips. To strike correctly, all hand and kicking techniques must use full range of motion while using the martial arts training device 100. By training with the martial arts training device 100, practitioners can increase their proficiency in making sensor-to-sensor contact with the electronic protective sparring equipment typically used in competitions, potentially increasing their ability to score in competitions. The placement of the inner frame 101 and the outer frame 102 compels the proper positioning of the body during strikes against the training bag. The two frames 101 and 102 have different centers and axes in relationship to each other and when attached to the standing bag 107 and the hanging bag 201. The unique design allows one or more persons of varying heights to practice strikes or kicks without adjusting the martial arts training device 100.

Figure 4:
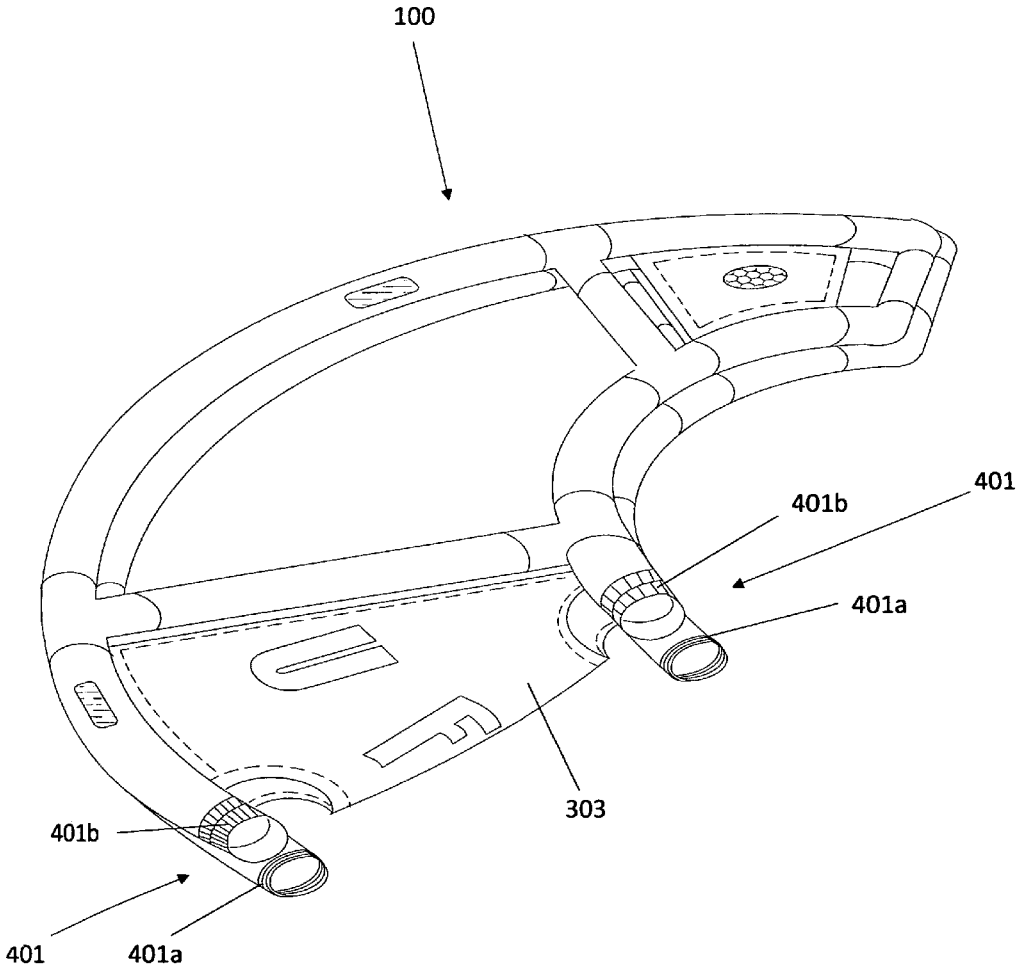
FIG. 4 is a perspective view of the martial arts training device shown in FIG. 1 disassembled and folded for storing and/or transport.

FIG. 4 illustrates the martial arts training device 100 unassembled and folded for storing and/or transport. The front visual skin 303, used as a visual aid in training, is also shown. A union fitting 401 is used to join and separate the martial arts training device 100. This figure shows the two union fittings 401, separated into a respective male union fitting 401*a* and female union fitting 401*b*. The martial arts training device 100 may be reassembled by unfolding the martial arts training device 100 and screwing the male union fitting 401*a* into the female union fitting 401*b*. The martial arts training device 100 may then be attached to a standing bag 107 or a hanging bag 201, as described above.

Figure 5A:
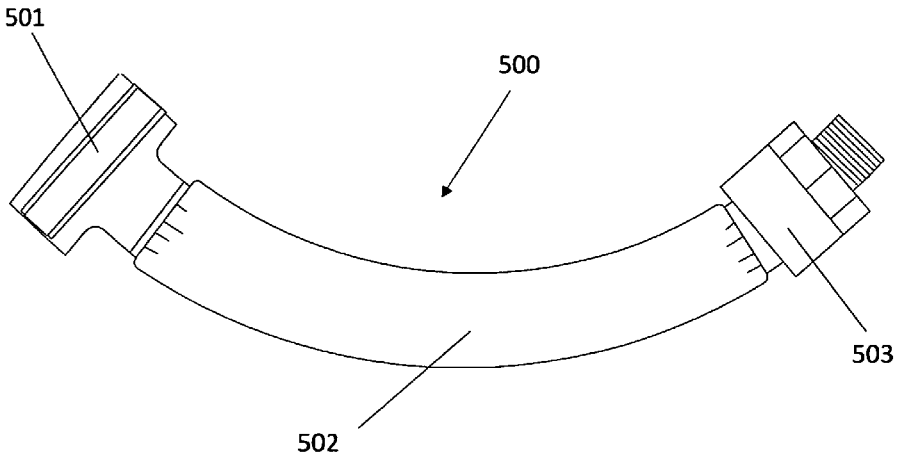
FIG. 5*a* is a perspective view of an exemplary main clamp that may be used to lock the martial training device shown in FIG. 1 onto the training bag.

FIG. 5*a* illustrates the main clamp 500 that locks the martial training device 100 onto the standing bag 107 and the hanging bag 201. The clamp 500 can be adjusted lengthwise to fit the circumferences of different sizes of standing bags 107 and hanging bags 201. A male adapter fitting 503 connected to the main clamp 500 is screwed into the female threaded tee fitting 301 of the martial arts training device 100. The purpose of the main clamp 500 is to hold the martial arts training device 100 in place during operation. A quick release 501 opens and closes the main clamp 500 by snapping onto a bar of the elbow 302 connecting to the inner frame 101 and the outer frame 102 of the martial arts training device 100. A clamp sleeve 502 protects the components of the main clamp 500. The clamp sleeve 502 can be made of vinyl, cloth, or a leather-type tubing material.

Figure 5B:
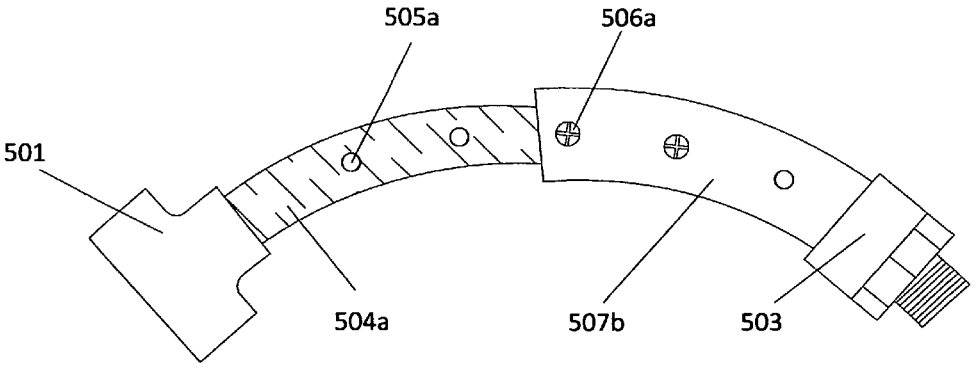
FIG. 5*b* is a perspective view of the main clamp shown in FIG. 5*a* with the clamp sleeve removed and the adjustment holes visible.

FIG. 5*b* illustrates the main clamp 500 with the clamp sleeve 502 removed. As shown in FIG. 5*b*, the main clamp 500 can be adjusted in length to fit various circumferences of standing bags 107 and hanging bags 201. The components of the main clamp 500 include an inner clamp shaft 504*a* which fits inside of an outer clamp shaft 507*a*. The outer clamp shaft 507*a* attaches to a male adapter fitting 503.

The inner clamp shaft 504*a* includes a series of adjustment holes 505*a* that may be used to lengthen or shorten the main clamp 500. The adjustment holes 505*a* are placed along the inner clamp shaft 504*a* to enable the inner clamp shaft 504*a* to be held with the outer clamp shaft 507*a* using one or more adjustment bolts 506*a*. The adjustment bolts 506*a* are inserted through the outer clamp shaft 507*a* into the adjustment holes 505*a*, where they tighten into the inner clamp shaft 504*a*. The overall main clamp 500 can be shortened or lengthened by this process, which can be performed with a simple screwdriver in a matter of minutes. This allows the practitioner to have a preset tension of the main clamp 500 for proper mounting of the martial arts training device 100. The inner clamp shaft 504*a* and the outer clamp shaft 507*a* can be made of a plastic- and/or rubber-type material.

Figure 6:
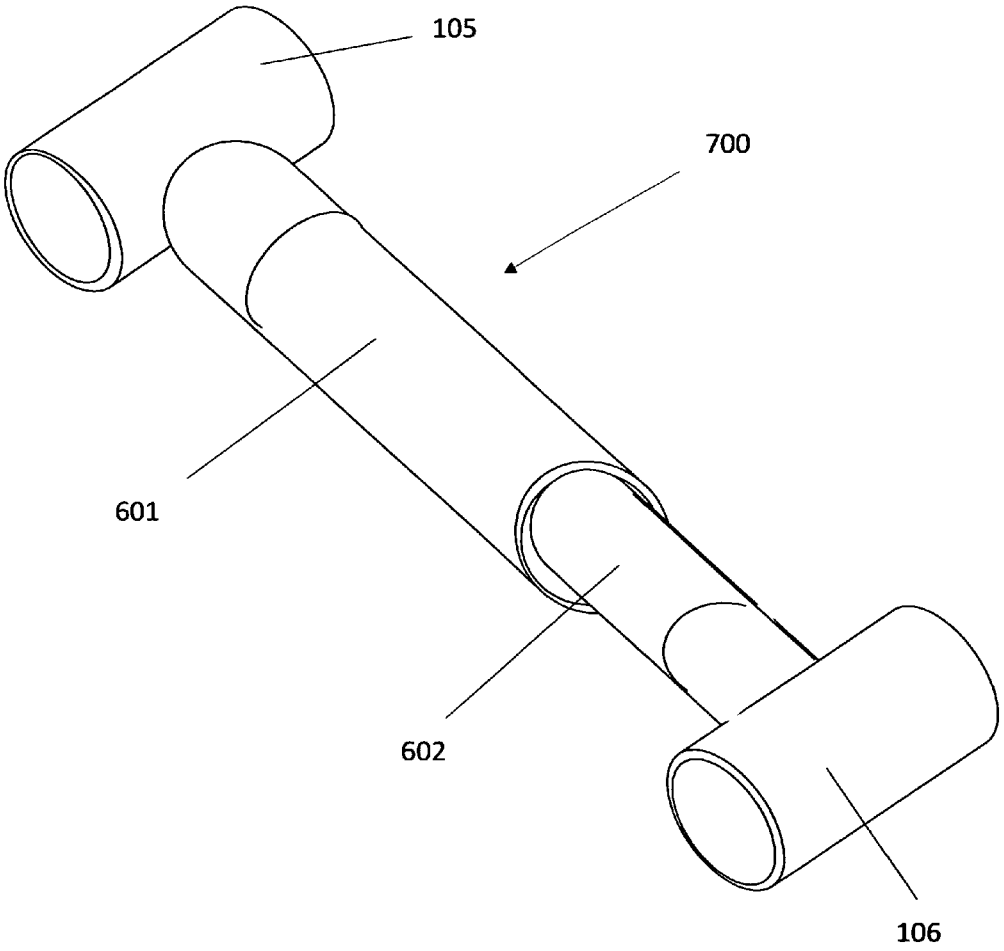
FIG. 6 is a perspective view of an exemplary inner shock absorber which may be located inside the front supports of the martial arts training device shown in FIG. 1.

FIG. 6 illustrates an inner shock absorber 600, which is located inside the front support shaft 104. The components of the inner shock absorber 600 include a non-threaded outer tee fitting 106 that connects an inner cylinder 602 to an outer cylinder 601. The outer cylinder 601 inserts into a non-threaded inner tee fitting 105. The non-threaded outer tee fitting 106 is connected to the outer frame 102, and the non-threaded inner tee fitting 105 is connected to the inner frame 101. When a strike hits the outer frame 102, the pressure causes the outer frame 102 to bend inwards towards the training bag. The inner cylinder 602 is pushed into the outer cylinder 601 to dissipate the impact. When the pressure of the strike is removed, the outer frame 102 automatically returns to its original position due to the partially bendable material of the outer frame 102. The martial arts training device 100 performs all these actions without using a spring or hydraulic system; instead, the device's own design creates a constant tension between the inner frame 101 and the outer frame 102 that causes the front shaft 104 to push outwards back to its normal position.

Figure 7A:
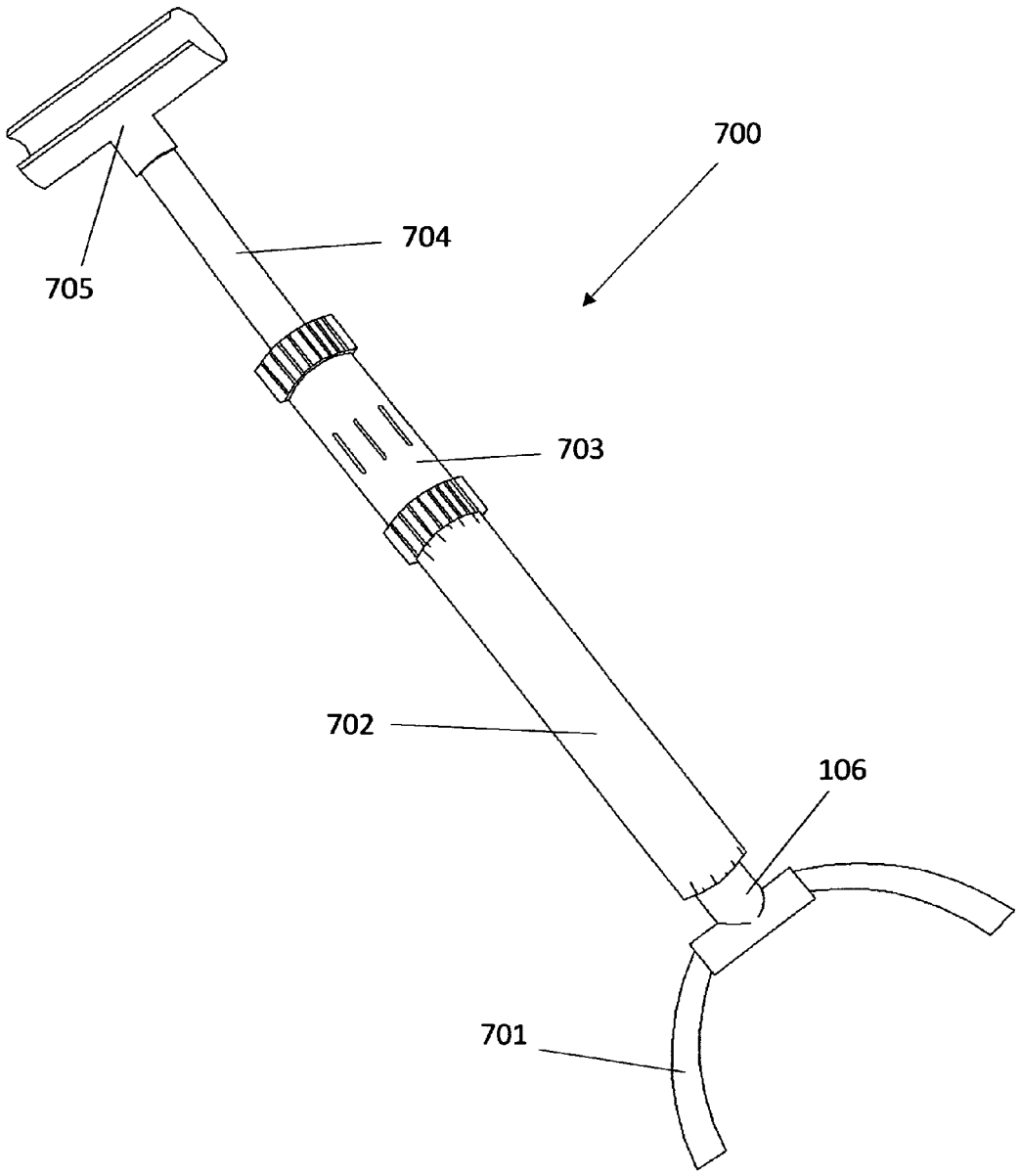
FIG. 7*a* is a perspective view of an exemplary stabilizer bar which may be attached to the martial arts training device shown in FIG. 1.

FIG. 7*a* illustrates a stabilizer bar 700, which is used to help support the martial arts training device 100 on the standing bag 107 during extensive training. The stabilizer bar 700 includes a base support 701, a non-threaded tee fitting 106, a stabilizer shaft 702, a stabilizer height adjuster 703, a stabilizer neck 704, and a frame clamp support 705. The base support 701 is mounted at the junction of the standing bag 107 and the standing bag base 108. The pressure and weight of the standing bag 107 holds the base support 701 in position. The non-threaded tee fitting 106 acts as a swivel point between the base support 701 and the stabilizer shaft 702. The stabilizer shaft 702 contains and holds the stabilizer neck 704 within the stabilizer bar 700. The stabilizer neck 704 is used to adjust the height of the stabilizer bar 700 to support the training martial arts device 100 by tightening or loosening the tension on the stabilizer neck 704, allowing it to telescopically adjust to the desired length. The frame clamp support 705 supports and maintains the position of the martial arts training device 100 by coupling and/or gripping the exterior of the outer frame 102. The frame clamp support 705 may include a Velcro-type fastening strap to help secure the outer frame 102 to the stabilizer bar 700.

Figure 7B:
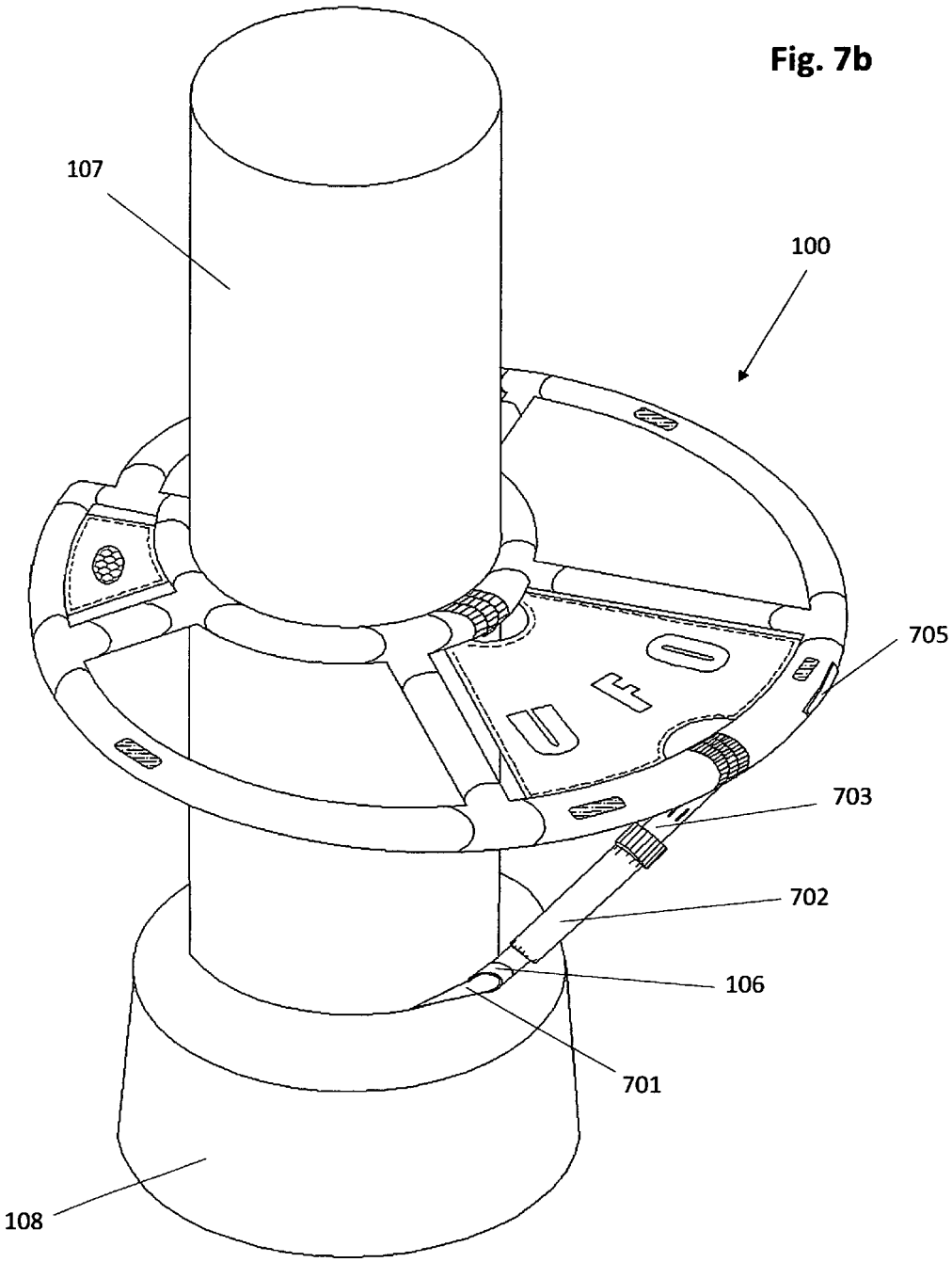
FIG. 7*b* is a perspective view of the stabilizer bar shown in FIG. 7*a* mounted to the martial arts training device shown in FIG. 1 and to a training bag.

FIG. 7*b* illustrates a stabilizer bar 700 installed with the martial arts training device 100 on a standing bag 107. The base support 701 is wedged between the standing bag 107 and the standing bag base 108. The non-threaded tee fitting 106 swivels into the angle needed to set a suitable height for the stabilizer bar 700 as the frame clamp support 705 secures the stabilizer bar 700 to the martial arts training device 100. All the components of the stabilizer bar 700 may be made of a plastic- and/or rubber-type material and a vinyl-type covering.

Exemplary embodiments of a martial arts training device are described above in detail. The martial arts training device is not limited to the specific embodiments described herein; rather, components of the martial arts training device may be utilized independently and separately from other components described herein. For example, the martial arts training device may also be used in combination with other sporting and/or training activities, and is not limited to practice with only the martial arts training bag as described herein. The exemplary embodiment can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to describe embodiments of the disclosure, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A martial arts training device for use with a cylindrical punching bag, the training device comprising:

an inner frame, the inner frame shaped to encircle an outer surface of the training bag and having a plurality of inner tee fittings, the inner tee fittings being positioned along the circumference of the inner frame and each having an opening facing outward from the inner frame;

an outer frame, the outer frame shaped to encircle the inner frame and having a plurality of outer tee fittings, the outer tee fittings being positioned along the circumference of the outer frame and each having an opening facing inward from the outer frame, each opening being aligned with a corresponding opening on the inner frame;

a plurality of support shafts connecting each of the inner tee fittings with the outer tee fittings, wherein the plurality of support shafts have different lengths such that the inner frame has a center that is different from a center of the outer frame;

a locking mechanism configured to adjust the width of the inner frame to fit the outer surface of the punching bag; and a secondary support ring, the secondary support ring configured to encircle the punching bag and shaped to support the inner circumference of the inner frame.

2. The martial arts training device of claim 1, the locking mechanism further including a main clamp having an inner clamp shaft and an outer clamp shaft configured to surround the inner clamp shaft, each shaft having a plurality of adjustment holes along the top and wherein a rod can be placed through a plurality of corresponding adjustment holes to adjust the width of the inner frame to fit the outer surface of the punching bag.

3. The martial arts training device of claim 2, wherein the main clamp is made of plastic or a rubber-type material.

4. The martial arts training device of claim 1, wherein at least one support shaft further includes one outer support shaft and one inner support shaft, the outer support shaft configured to fit over the outer support shaft.

5. The martial arts training device of claim 1, wherein the inner frame and the outer frame each further include a union fitting, the union fitting configured to enables the martial arts training device to separate.

6. The martial arts training device of claim 1, the training device further including at least one touch sensor along the outer frame, the touch sensor configured to detect impact on the training device.

7. The martial arts training device of claim 6, the training device further including at least one speaker configured to emit a sound in response to the impact detected by the touch sensor.

8. The martial arts training device of claim 1, wherein the outer frame is at least partially covered by a padded material.

9. The martial arts training device of claim 1, further comprising at least one visual skin connected to the inner frame and the outer frame.

10. The martial arts training device of claim 1, the martial arts training device further including at least one stabilizing bar, the stabilizing bar including a base support, a support tee fitting, and a support shaft connecting the base support and the support tee fitting, the support tee fitting configured to attach to a section of the outer frame.

11. The martial arts training device of claim 10, the stabilizing bar including one outer stabilizing shaft and one inner stabilizing shaft, the outer stabilizing shaft configured to fit over the outer stabilizing shaft and wherein the stabilizer bar has an adjustable length.

12. A martial arts training device for use with a cylindrical punching bag, the training device comprising:

an inner frame, the inner frame shaped to encircle an outer surface of the punching bag and having a plurality of inner tee fittings, the inner tee fittings being positioned along the circumference of the inner frame and each having an opening facing outward from the inner frame;

an outer frame, the outer frame shaped to encircle the inner frame and having a plurality of outer tee fittings, the outer tee fittings being positioned along the circumference of the outer frame and each having an opening facing inward from the outer frame, each opening being aligned with a corresponding opening on the inner frame;

a plurality of support shafts connecting each of the inner tee fittings with the outer tee fittings, wherein the plurality of support shafts have different lengths such that the inner frame has a center that is different from a center of the outer frame;

a locking mechanism configured to adjust the width of the inner frame to fit the outer surface of the punching bag;

a secondary support ring, the secondary support ring configured to encircle the punching bag and shaped to support the inner circumference of the inner frame; and a stabilizing bar, the stabilizing bar including a base support, a support tee fitting, and a support shaft connecting the base support and the support tee fitting, the support tee fitting configured to attach to a section of the outer frame.

13. A martial arts training device for use with a cylindrical punching bag, the training device comprising:

an inner frame, the inner frame shaped to encircle an outer surface of the punching bag and having a plurality of inner tee fittings, the inner tee fittings being positioned along the circumference of the inner frame and each having an opening facing outward from the inner frame;

an outer frame, the outer frame shaped to encircle the inner frame and having a plurality of outer tee fittings, the outer tee fittings being positioned along the circumference of the outer frame and each having an opening facing inward from the outer frame, each opening being aligned with a corresponding opening on the inner frame;

a plurality of support shafts connecting each of the inner tee fittings with the outer tee fittings, wherein the plurality of support shafts have different lengths such that the inner frame has a center that is different from a center of the outer frame;

a locking mechanism configured to adjust the width of the inner frame to fit the outer surface of the punching bag; and a secondary support ring, the secondary support ring configured to encircle the punching bag and shaped to support the inner circumference of the inner frame.

* * * * *